United States Patent [19]

Perulfi

[11] 4,293,747

[45] Oct. 6, 1981

[54] HIGH-VOLTAGE PUFFER-TYPE COMPRESSED-GAS CIRCUIT-INTERRUPTER ASSEMBLAGE

[75] Inventor: John R. Perulfi, Monroeville, Pa.

[73] Assignee: Westinghouse Electric Corp., Pittsburgh, Pa.

[21] Appl. No.: 7,052

[22] Filed: Jan. 29, 1979

Related U.S. Application Data

[63] Continuation of Ser. No. 713,559, Aug. 11, 1976, abandoned.

[51] Int. Cl.[3] ..... H01N 33/14; H01N 9/40

[52] U.S. Cl. ..... 200/145; 200/148 R; 200/148 F

[58] Field of Search ..... 200/145, 148 R, 148 A, 200/148 F, 148 H

[56] References Cited

U.S. PATENT DOCUMENTS

| | | | |
|---|---|---|---|
| 2,913,559 | 11/1959 | Cromer | 200/148 A |
| 3,291,947 | 12/1966 | Van Sickle | 200/148 H |
| 3,352,988 | 11/1967 | Wachta et al. | 200/145 |
| 3,567,887 | 3/1971 | Maloney | 200/145 |
| 3,674,959 | 7/1972 | Clark | 200/145 |
| 3,679,851 | 7/1972 | Latour et al. | 200/148 A |
| 3,846,601 | 11/1974 | Leeds | 200/148 F |

FOREIGN PATENT DOCUMENTS

| | | | |
|---|---|---|---|
| 575023 | 3/1958 | Italy | 200/148 R |
| 386528 | 4/1965 | Switzerland | 200/148 R |

*Primary Examiner*—Robert S. Macon
*Attorney, Agent, or Firm*—M. S. Yatsko

[57] ABSTRACT

A generally cross-shaped, or "T"-shaped circuit-interrupter assemblage is provided having three outwardly radiating supporting arms, or members, within each of which is disposed a puffer-type compressed-gas circuit-interrupting unit. Common contact-operating means are provided at the common point of intersection of the three arms, or legs, so that simultaneous operation of the three puffer-type interrupters is accomplished. The electrical circuit passes serially through each of the three puffer-interrupting structures to thereby provide a high-voltage circuit-interrupter adaptable for voltages of the order of 345 KV, for example.

An additional feature of the present invention is the provision of a common rotatable operating disc having pivotally connected thereto, adjacent its outer periphery, floating-connecting link structure, each of the three floating links being pivotally connected to the respective movable contact-operating rod of each of the three puffer-type interrupting units. An additional operating, or "pull" rod connected adjacent the periphery of the common rotatable operating disc acts as a common pull-rod extending to ground potential to thereby enable the operation of said disc at high voltage.

An additional feature of the present invention is the provision of a closing resistance, when desired, for each of the three puffer-type circuit-interrupters. Still a further feature of the invention is the provision of two such cross-shaped, or "T"-shaped interrupting structures for the provision of six serially-related breaks for extremely high voltages, such as 550 KV or 765 KV, for example.

1 Claim, 8 Drawing Figures

HIGH-VOLTAGE PUFFER-TYPE COMPRESSED-GAS CIRCUIT-INTERRUPTER ASSEMBLAGE

CROSS-REFERENCE TO RELATED APPLICATIONS

This is a continuation of application Ser. No. 713,559, filed Aug. 11, 1976, now abandoned.

BACKGROUND OF THE INVENTION

The present invention is particularly related to puffer-type compressed-gas circuit-interrupters of the type in which only a single internal pressure of gas, such as sulfur-hexafluoride ($SF_6$) gas, for example, is utilized within the interrupting structure. A difference of gas pressure for arc interruption is achieved by appropriate piston action, that is, relative movement of an operating cylinder to a piston structure. Attention may be directed to U.S. Pat. Nos.: 3,839,613—Tsubaki et al; 3,602,670—Calvino Teijeiro; 3,849,616—Clavino Teijeiro; 3,670,124—Calvino Teijeiro; 3,670,125—Calvino Teijeiro; and 3,712,969—Calvino Teijeiro.

As well known by those skilled in the art, the relative motion between the movable operating cylinder assembly and the fixed piston achieves a desirable compression of gas within the intervening compression chamber, which compressed gas is utilized during arc interruption by generally forcing the compressed high-pressure gas, such as $SF_6$ gas, for example, through a movable insulating nozzle structure to direct the high-pressure gas flow intimately into engagement with the established arc drawn within the movable insulating nozzle to effect the latter's extinction.

DESCRIPTION OF THE PRIOR ART

The present invention relates to puffer-type circuit-interrupters of the type set forth in U.S. Pat. No. 3,551,623, issued Dec. 29, 1970, to Robert G. Colclaser, Jr. and William H. Fischer. This patent shows the relative motion of a movable piston within a relatively stationary operating cylinder, with electromagnetic coils energizing a companion movable piston, which is electrically repelled toward the first-mentioned movable piston, the latter being attached to, and movable with, a contact-operating rod.

As well known by those skilled in the art, there are many patents treating different piston structures, for example, U.S. Pat. No. 2,429,311, issued Oct. 21, 1947, to M. J. Gay; and U.S. Pat. No. 3,786,215, issued Jan. 15, 1974 to Gerhard Mauphe.

An additional patent of interest in connection with piston structures is U.S. Pat. No. 3,331,935, issued July 18, 1967 to Stanislaw A. Milianowicz. Another piston patent, utilizing hydraulic action for effecting piston action, is U.S. Pat. No. 2,913,559, issued Nov. 17, 1959, to Charles F. Cromer. An additional patent of interest is German Pat. No. 671,326 patented to Germany, Oct. 1937. All of the aforesaid patents indicated that puffer-type piston structures of the prior art are well known.

BRIEF SUMMARY OF THE INVENTION

An improved high-voltage puffer-type compressed-gas circuit-interrupter assemblage is provided having a generally cross-shaped, or "T"-shaped interrupting structure with the three legs thereof accommodating interiorly-disposed, gas-surrounded puffer-type interrupting units. The three gas-immersed puffer-units are preferably electrically connected in series to thereby enable the interruption of very high voltages. Such a structure may constitute a module, two of which, when provided, enable six breaks to be established in series enabling an extremely high-voltage circuit to be interrupted, such as 345 KV, for example.

Preferably, a unique and novel common operating mechanism is utilized to simultaneously effect the contact-opening movement of each of the three puffer-type units for the module, or assemblage, the common operating mechanism of which is disposed advantageously at the point of intersection of the three arms, or legs constituting, collectively, a generally cross-shaped or "T"-shaped interrupting structure, or assemblage.

One common type of operating mechanism, which may be used for effecting the opening and closing operations of the three serially-related puffer-type interrupting units, is a rotatable operating disc rotatable about its center, and having pivotally connected thereto adjacent its outer periphery interconnecting floating-link structures, each link of which may be individually pivotally connected to the movable contact-operating rod of one of the three puffer-interrupting units. An additional floating link, pivotally connected to the periphery of said operating disc, may constitute a "pull", or operating-rod extending downwardly to ground potential.

As an additional feature, each of the puffer-type interrupting units may include, where desired, a closing resistance, thereby avoiding voltage surges being imposed on the electrical line during the closing operation of the assemblage. Such closing resistances are, of course, out of the interrupting circuit on the opening operation of the breaker.

DESCRIPTION OF THE PREFERRED EMBODIMENTS

Figure 1:
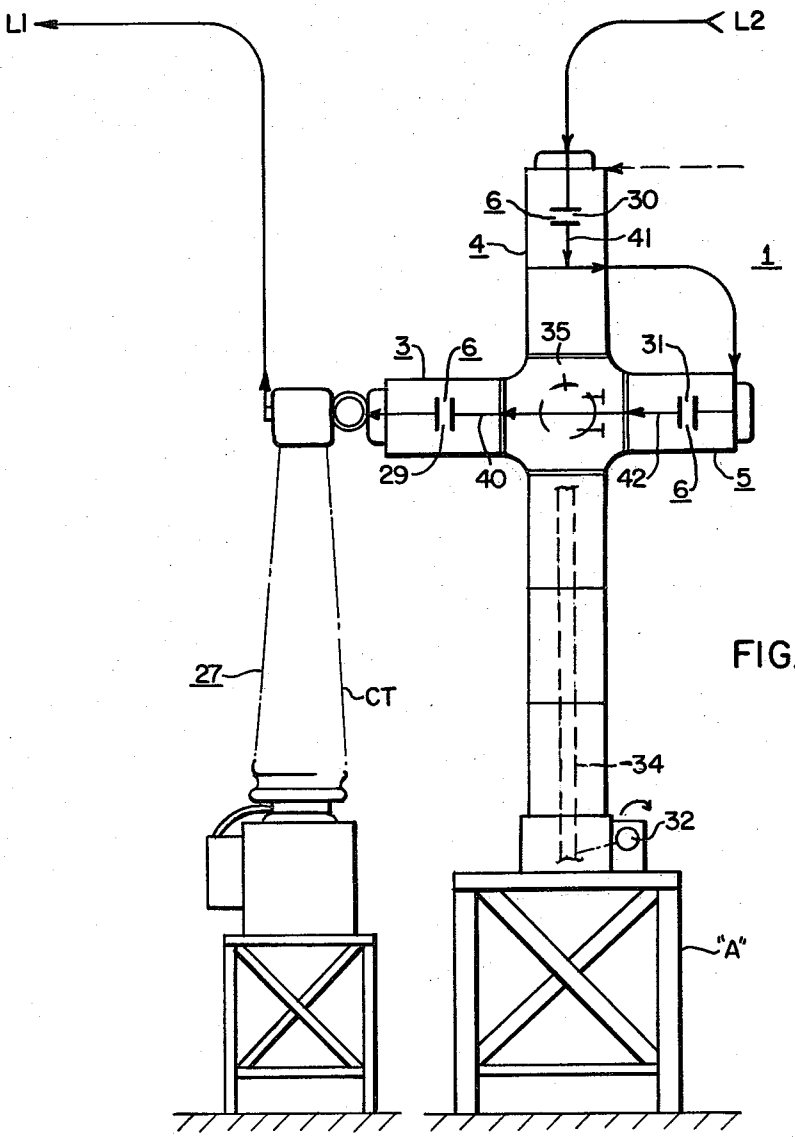
FIG. 1 is a side-elevational view of one phase-unit, or pole-unit of a three-phase interrupting structure illustrating somewhat diagrammatically the series electrical connections passing through the three puffer-type interrupting units.
Figure 3:
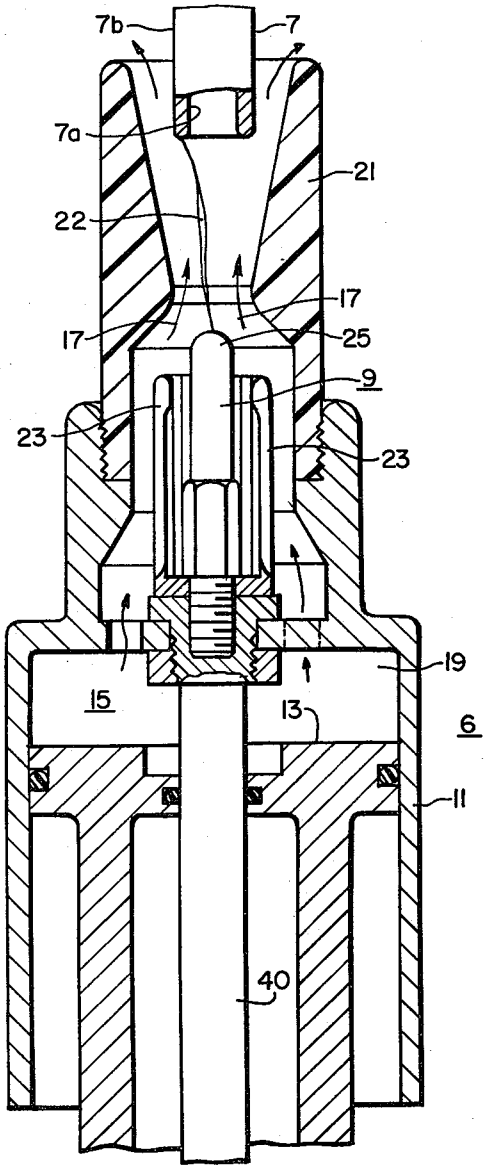
FIG. 3 illustrates, in an enlarged manner, a typical puffer-type interrupting unit, one of which is disposed in each of the three arms, or legs of the interrupting structure, the view illustrating the arcing position of the separable contacts.

Referring now to the drawings, and more particularly to FIG. 1 thereof, there is illustrated somewhat diagrammatically a high-voltage puffer-type circuit-interrupter 1 utilizing three puffer-type interrupting units 3–5 in series, as shown. Each of the puffer-type interrupting units 3–5 is of the type generally shown in FIG. 3 of the drawings, which shows unit 4 in particular. With reference to FIG. 3, it will be observed that there is provided a stationary contact 7, which may be, when desired, tubular, as at 7*a*, cooperating with a movable contact structure 9, the latter being movable with an operating cylinder 11, the latter movable over a fixed piston structure 13 to compress gas within the piston region 15. As indicated by the arrows 17, such compressed-gas 19 flows out through an insulating nozzle 21 and into the established arc 22. Reference may be had to U.S. Pat. No. 3,679,851, issued July 25, 1972 to Latour et al for a detailed description of the interrupting structure 4.

As well known by those skilled in the art, with further reference being directed to FIG. 3, during the closing operation the movable contact structure 9 moves upwardly causing a contact reengagement of the movable finger contacts 23 with the external surface 7*b* of the relatively-stationary tubular contact 7, the arcing probe 25 projecting into the interior 7*a* of the tubular stationary contact 7.

Figure 2:
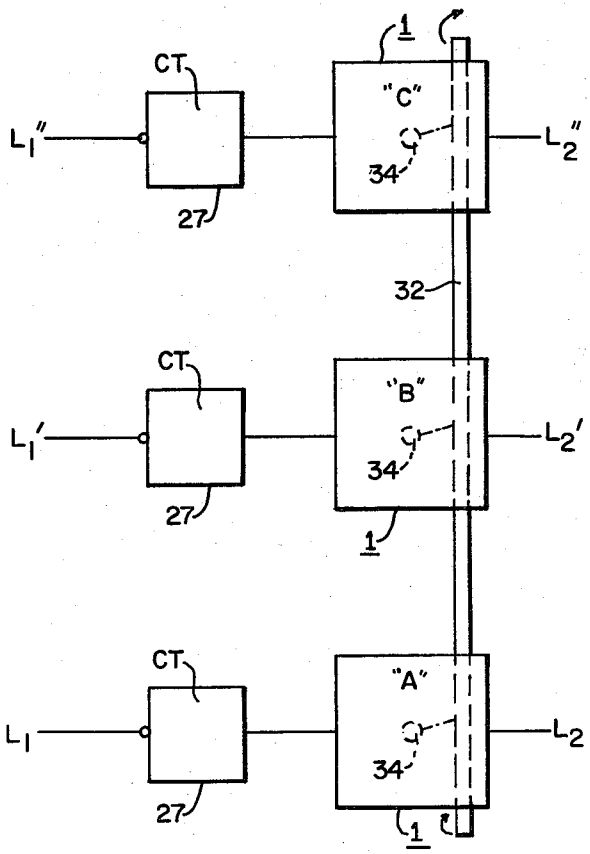
FIG. 2 is a somewhat diagrammatic top plan view looking downwardly upon the three pole-units, illustrating the arrangement of the common operating-shaft construction.

FIG. 1 illustrates that the three puffer-type interrupting-units 3–5 are electrically connected in series, and the electrical circuit is, in turn, connected to a suitable current-transformer structure 27, which may be of a conventional type, and constitutes no part of the present invention. Thus, as illustrated in FIG. 1, the high-voltage circuit-interrupter 1 comprises three breaks 29–31 in series, and FIG. 2 illustrates that all of them may be commonly operated by a rotatable shaft 32, which effects vertical opening and closing movements of a vertically-extending pull-rod 34, which connects to a rotatable operating disc 35, which has pivotally-connected thereto, adjacent its outer periphery, floating links 36–38, each of which may be connected to one of the movable contact-operating rods 40–42 (FIG. 3) of each of the puffer-type interrupting units 3–5. The simultaneous opening and closing operations of the three puffer-units 3–5 is thereby obtained.

Figure 6:
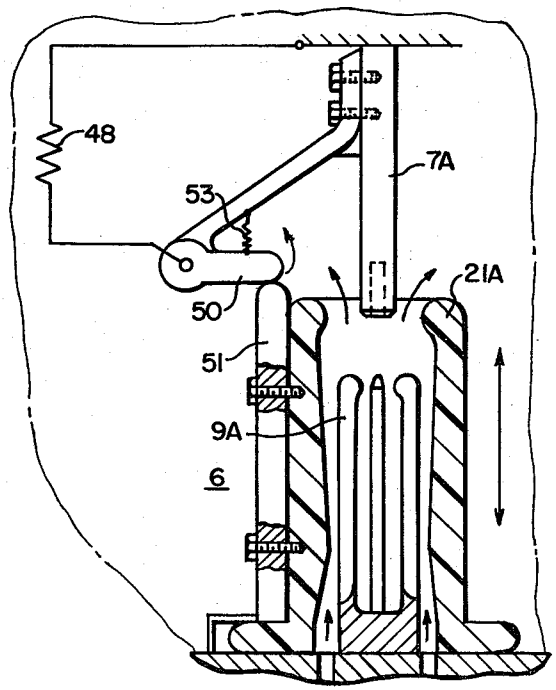
FIG. 6 illustrates more in detail the separable contact structure for accommodating a closing resistance incorporated in one or more of the three puffer-type interrupting units.
Figure 5:
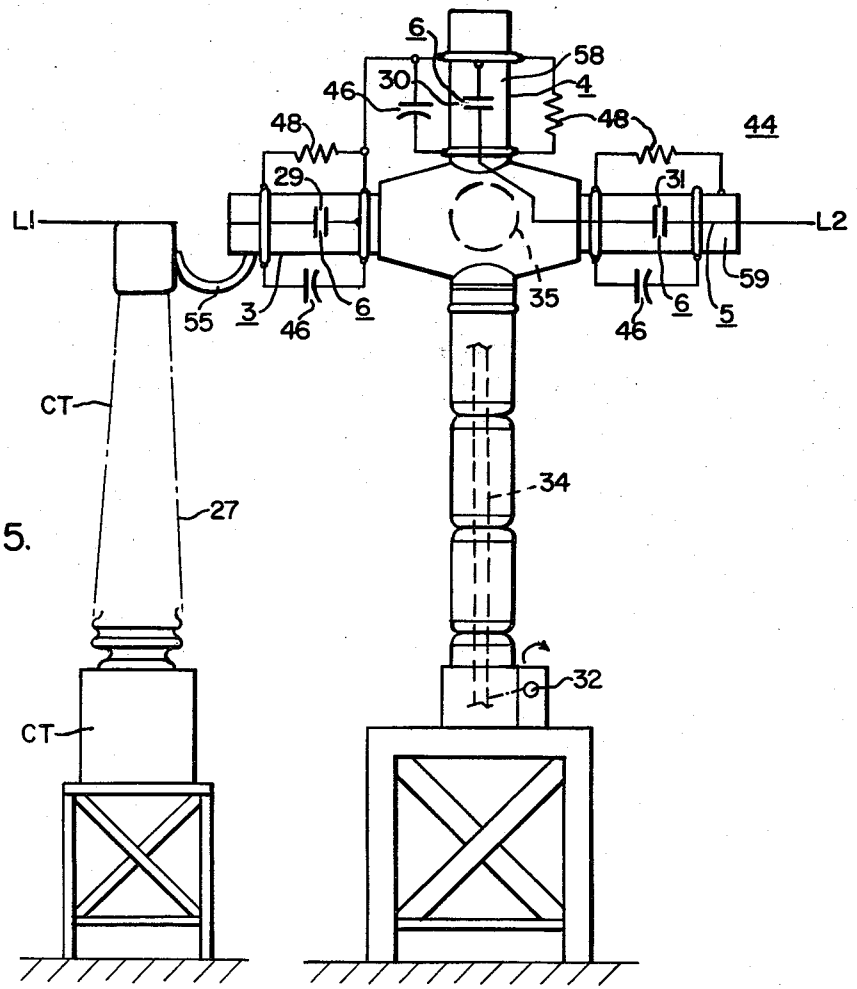
FIG. 5 illustrates somewhat diagrammatically the utilization of capacitors for controlling the division of voltage, and the general use of closing resistances together with an additional means of support from an adjacently-disposed current-transformer structure.

FIG. 5 illustrates a modification 44 of the invention in which capacitors 46 are utilized to control the division of voltage between the three breakers 29–31. Additionally, resistances 48 are employed in connection with each of the puffer-units 3–5, FIG. 6 illustrating in more detail the manner of insertion of the closing resistance "R" during the closing operation, and the delay associated with the resistance contacts 50, 51 on opening, so that opening occurs without the intervention of the closing resistance "R". In other words, the opening operation takes place entirely as though the resistances "R" were not present. However, in the fully-open-circuit position of the interrupter 44, the slow-acting and relatively-weak compression spring 53 positions the rotatable resistance contact 50 in a location, where it is engaged on the closing stroke by the movable resistance contact-probe 51. Obviously, therefore, the resistance "R" is inserted on the closing stroke, and is not inserted during the opening stroke. As set forth in U.S. Pat. No. 3,291,947, issued Dec. 13, 1966 to Roswell C. Van Sickle, the utilization of such a closing resistance "R" has advantageous benefits by preventing voltage surges occurring on the transmission line L1, L2 during the closing operation.

FIG. 5 additionally shows the utilization of the current-transformer structure 27 as an additional support, if required, by the heavy flexible interconnecting straps 55 providing a supporting interconnection between the upper end of the current-transformer structure 27 and the left-hand puffer-interrupting unit 57.

Figure 4:
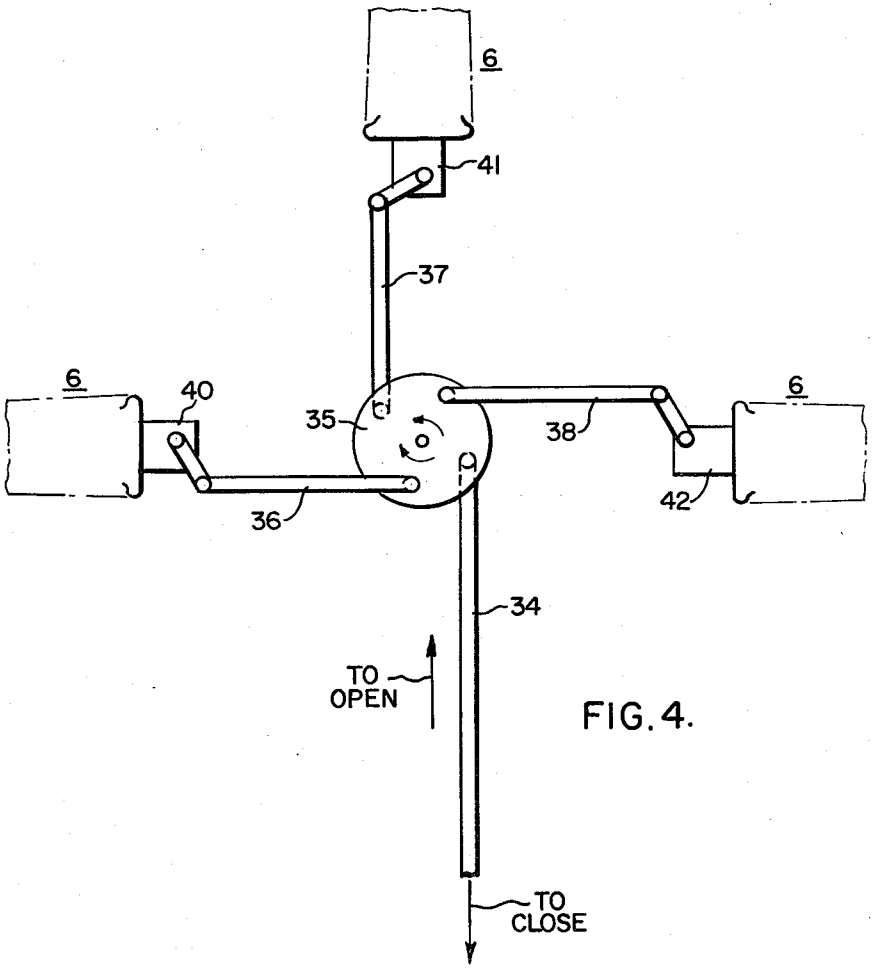
FIG. 4 diagrammatically illustrates the common rotatable operating disc, which may be linked to each of the three individual puffer-units and its rotative method of common operation.
Figure 7:
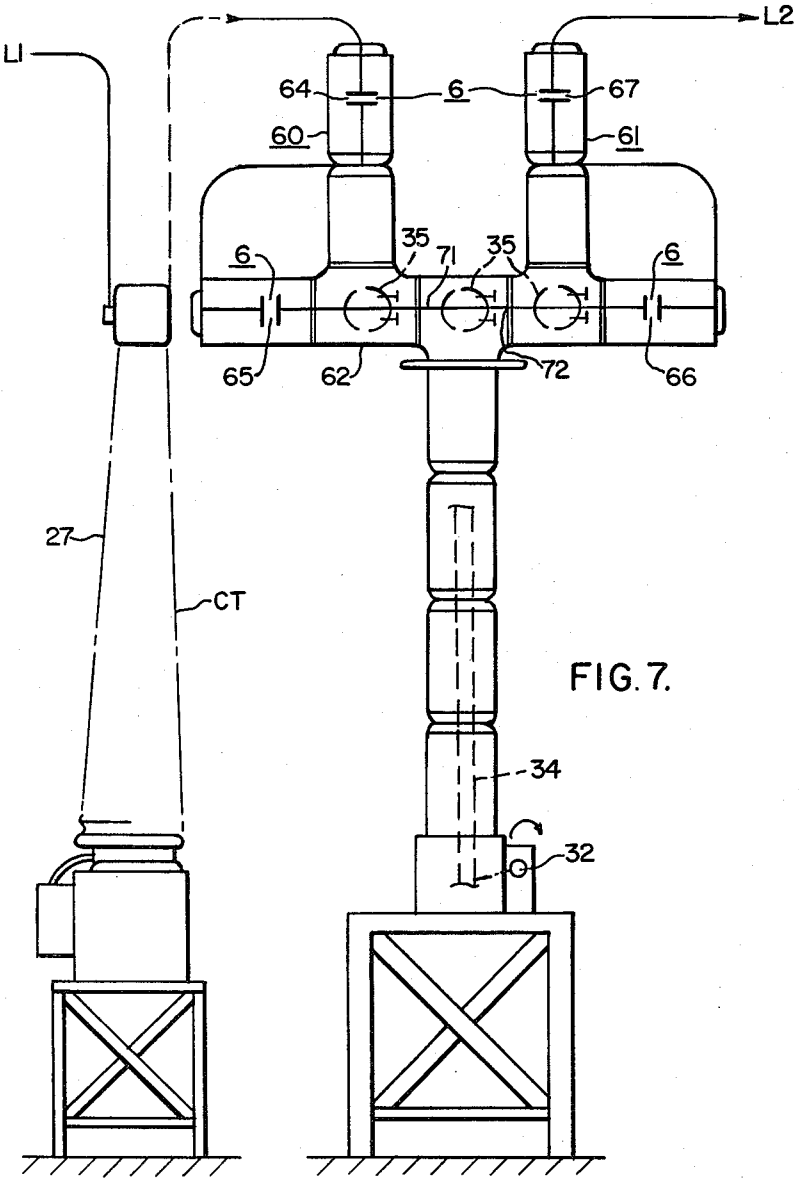
FIG. 7 illustrates a modified-type of interrupter construction in which an additional puffer-type interrupting unit is incorporated into the structure, or assemblage; and, FIG. 8 illustrates two series modules, or assemblages, each of which is of the type illustrated in FIG. 1, both being connected in electrical series for providing six breaks for interrupting the higher-voltage ratings.

FIG. 7 illustrates a further modification of the invention, wherein two upstanding legs 60, 61 are provided projecting upwardly from a horizontal longitudinal insulating portion 62, as diagrammatically illustrated in FIG. 7, four breaks 64–67 may easily be provided. Again, rotatable operating discs 35 may be utilized being mechanically interconnected by floating links 71, 72, as illustrated diagrammatically more clearly in FIG. 4.

Figure 8:
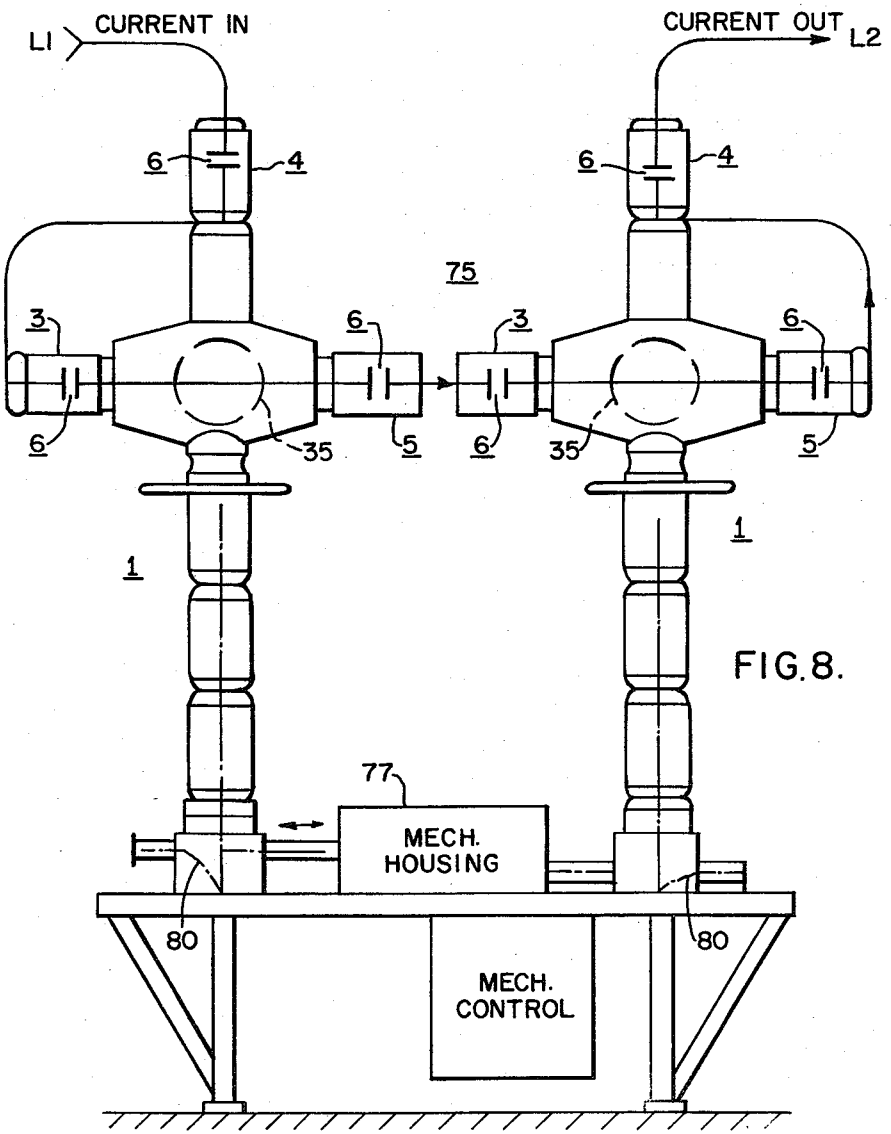

For interrupting extremely high-voltage circuits, the provision of six interrupting breaks, rather than three breaks, may be easily accommodated by the structure 75 set forth in FIG. 8, wherein two series modules 1 are provided, each of which is generally of the type set forth in FIG. 1. As diagrammatically illustrated in FIG. 8, six breaks are thus provided, and the common operating mechanism 77 for each module 1 may be interconnected by a lower rotatable shaft 79 and lever arrangement 80, as illustrated more clearly in FIG. 2.

From the foregoing description, it will be apparent that there has been provided an improved high-voltage circuit-interrupting structure 1, in which several interrupting puffer-units 3–5 may be easily connected serially into the circuit to provide three and four breaks per module 1. For the still higher voltages, two modules 1 may be arranged in series, as illustrated in FIG. 8, to enable the interruption of the higher-voltage circuits. Closing resistances "R" may be readily accommodated by the contact structure exemplified in FIG. 6, and enabling the insertion of closing resistances "R" into the circuit only during the closing operation of the breaker.

Although there has been illustrated and described specific structures, it is to be clearly understood that the same were merely for the purpose of illustration, and that changes and modifications may readily be made therein by those skilled in the art, without departing from the spirit and scope of the invention.

I claim:

1. A high-voltage circuit-interrupting assemblage comprising an upstanding supporting columnar structure; a first horizontally-extending supporting structure secured to, and supported by, said upstanding supporting columnar structure, said first horizontally-extending supporting structure having disposed therein a first common operating mechanism; a pair of second horizontally-extending supporting structures one each of which is secured to each end of said first horizontally-extending supporting structure, each of said second supporting structures having disposed therein a second common operating mechanism operatively connected to said first common operating mechanism such that said first and second operating mechanism operate simultaneously; a first hollow leg secured to each second supporting structure disposed generally parallel to said upstanding supporting columnar structure and a second hollow leg secured to each second supporting structure disposed along the axis of said first horizontally-extending supporting structure; an interrupting unit disposed in each of said first and second hollow legs, said interrupting units being operatively connected to said second common operating mechanisms and effecting simultaneous opening and closing of all of said interrupting units; and means for connecting said interrupting units in electrical series.

* * * * *